United States Patent [19]

Ishikawa et al.

[11] Patent Number: 4,799,622

[45] Date of Patent: Jan. 24, 1989

[54] ULTRASONIC ATOMIZING APPARATUS

[75] Inventors: Kiyoe Ishikawa, Oi; Kakuro Kokubo, Atsugi; Hitoshi Kurokawa, Oi; Daijiro Hosogai, Kawashima; Hirokazu Takenaka, Hachioji, all of Japan

[73] Assignee: Tao Nenryo Kogyo Kabushiki Kaisha, Tokyo, Japan

[21] Appl. No.: 79,742

[22] Filed: Jul. 30, 1987

[30] Foreign Application Priority Data

| | | | |
|---|---|---|---|
| Aug. 5, 1986 | [JP] | Japan | 61-182755 |
| Aug. 8, 1986 | [JP] | Japan | 61-185308 |
| Aug. 8, 1986 | [JP] | Japan | 61-185309 |
| Aug. 8, 1986 | [JP] | Japan | 61-185310 |
| Sep. 3, 1986 | [JP] | Japan | 61-207183 |
| Sep. 12, 1986 | [JP] | Japan | 61-139408[U] |

[51] Int. Cl.[4] ..... B05B 1/26; B05B 3/14

[52] U.S. Cl. ..... 239/102.2; 239/294; 239/519; 310/323; 74/155

[58] Field of Search ..... 239/102.2, 4, 500, 502, 239/294, 519; 123/590; 310/323; 74/155

[56] References Cited

U.S. PATENT DOCUMENTS

| | | | |
|---|---|---|---|
| 578,461 | 3/1897 | Mertz | 239/498 |
| 1,659,538 | 2/1928 | Angrove . | |
| 1,730,664 | 10/1929 | Kruse | 239/590.5 X |
| 1,758,119 | 5/1930 | Le Moon | 239/460 |
| 1,954,173 | 4/1934 | Histed | 239/489 |
| 2,005,600 | 6/1935 | Tappen . | |
| 2,596,341 | 5/1952 | McCreery et al. | 239/590.5 |
| 2,712,962 | 7/1955 | Goddard | 239/500 X |
| 2,779,623 | 1/1957 | Eisenkraft . | |
| 3,110,444 | 11/1963 | Eakins | 239/500 |
| 3,145,931 | 8/1964 | Cleall | 239/102.2 |
| 3,317,139 | 5/1967 | Freeland | 239/102 |
| 3,373,752 | 3/1968 | Inoue | 239/4 |
| 3,749,318 | 7/1973 | Cottell | 239/102 |
| 3,756,575 | 9/1973 | Cottell | 261/1 |
| 4,153,201 | 5/1979 | Berger et al. | 239/102.2 |
| 4,197,997 | 4/1980 | Wu et al. | 239/102 |
| 4,350,302 | 9/1982 | Gruber et al. | 239/500 |
| 4,372,491 | 2/1983 | Fishgal | 239/102 |
| 4,389,999 | 6/1983 | Jaqua | 239/102.2 X |
| 4,402,458 | 9/1983 | Lierke et al. | 239/102.2 |
| 4,403,741 | 9/1983 | Moriya et al. | 239/585 |
| 4,408,722 | 10/1983 | Freland | 239/533.12 |
| 4,473,187 | 9/1984 | Lierke et al. | 239/102.2 |
| 4,474,326 | 10/1984 | Takahashi | 239/102 |
| 4,496,101 | 1/1985 | Northman | 239/102 |
| 4,501,406 | 2/1985 | Walther et al. | 251/30 |
| 4,541,564 | 9/1985 | Berger et al. | 239/102 |
| 4,607,239 | 8/1986 | Ballato | 331/176 |
| 4,689,515 | 8/1987 | Benndorf et al. | 239/102.2 X |
| 4,690,332 | 9/1987 | Hughes | 239/338 |

FOREIGN PATENT DOCUMENTS

| | | | |
|---|---|---|---|
| 752747 | 2/1967 | Canada . | |
| 0159189 | 10/1985 | European Pat. Off. | 239/102 |
| 202102 | 11/1986 | European Pat. Off. | 239/102.2 |
| 861344 | 12/1952 | Fed. Rep. of Germany . | |
| 2239408 | 2/1974 | Fed. Rep. of Germany . | |
| 786492 | 9/1935 | France | 239/498 |
| 803553 | 10/1936 | France . | |
| 144826 | 1/1962 | U.S.S.R. | 239/102.2 |
| 589031 | 2/1978 | U.S.S.R. . | |
| 2073616 | 10/1981 | United Kingdom | 239/102.2 |

*Primary Examiner*—Andres Kashnikow
*Assistant Examiner*—Mary Beth O. Jones
*Attorney, Agent, or Firm*—Seidel, Gonda, Lavorgna & Monaco

[57] ABSTRACT

An ultrasonic atomizing apparatus including an ultrasonic vibration generator and an ultrasonic vibrator horn having a cylindrical section connected at one end to the ultrasonic vibration generator and having a flared portion connected to the other end of the cylindrical section. The flared portion is flared and enlarged in diameter towards the tip end of the horn and is adapted to atomize liquid material on the flared portion as the liquid material is supplied from a liquid material supply nozzle to the flared portion. A hollow recess is formed in the flared portion opening toward the tip end of the horn. The geometry of the hollow recess is such that the cross-sectional area of the flared portion of the horn in any plane perpendicular to the longitudinal axis of the horn is the same as the cross-sectional area of the flared portion in all other planes perpendicular to the longitudinal axis of the horn. The horn also has a single nodal point positioned above a boundary between the cylindrical section and the flared portion when the horn is ultrasonically excited.

29 Claims, 18 Drawing Sheets

CURVE A
CURVE B
⊙ CONICAL HORN AMPLITUDE 12 µm
▾ CONICAL HORN AMPLITUDE 14 µm
⊡ CONICAL HORN AMPLITUDE 20 µm
× SOLID COTTELL HORN AMPLITUDE 12 µm MAX AMPLITUDE
MEAN PARTICLE DIAMETER SMD(µm)
RATE OF ATOMIZATION Q(ℓ/Hr)
0
20
40
60
80
100
120
0
5
10
15
20
25
30
35

ULTRASONIC ATOMIZING APPARATUS

TECHNICAL FIELD

The present invention relates generally to the art of atomizing liquid material by ultrasonic vibration, and particularly to an ultrasonic atomizing apparatus for atomizing and vaporizing fuel for internal combustion engines such as diesel engines and gasoline engines and external combustion engines such as boilers and burners and also suitably useful for drying and producing powdered medicines. While this invention is useful for atomizing liquid material in various applications as mentioned above, the invention will be mainly described hereinafter with respect to atomizing and vaporizing liquid fuel for internal combustion engines such as diesel engines and gasoline engines by ultrasonic vibrations. The term "liquid material" herein used is intended to mean not only a liquid such as liquid fuel but also various solutions and slurries such as liquid for producing medicines.

BACKGROUND OF THE INVENTION

As is well known, the ultrasonic atomizing apparatus of the type described herein includes ultrasonic vibration generating means having an electric-acoustic transducer and a high frequency oscillator, and an ultrasonic vibrator horn powered by the ultrasonic vibration generating means for atomizing liquid material such as liquid fuel supplied. The spray properties of the ultrasonic vibrator horn such as the flow rate of liquid fuel spray as atomized, the particle size of the atomized droplets, etc. have various effects on the performance of a combusting apparatus incorporating such ultrasonic atomizer. For example, poor spray properties of the ultrasonic vibrator horn may bring forth various troubles such as inability to effect precise control of fuel-air ratio in the combusting apparatus, and worsened combusting conditions which may lead to an increase in the amount of hydrocarbon and carbon monoxide contained in the exhaust gases as well as an increase in the amount of soot produced. In order to eliminate such troubles it is required to improve the atomizing properties of the ultrasonic vibrator horn as described above.

Many attempts have heretofore been made to improve the combusting efficiency by applying ultrasonic vibration to atomize liquid fuel in order to obtain desirable burning conditions in a combustor. However, there are few of the heretofore proposed ultrasonic atomizing devices that have a throughput (say, about 10 cc/sec) sufficient to atomize all of the fuel as supplied to an internal combustion engine in a satisfactory atomizing efficiency without worsening the spray properties as required depending upon the load or the like by a practical size of ultrasonic atomizer. Japanese Patent Public Disclosure No. 37017/1974 to Eric C. Cottell discloses an ultrasonic fuel atomizing apparatus which is intended to be applied primarily to internal combustion engines.

With the apparatus as disclosed in the aforesaid Japanese point a plan public disclosure, however, when applied to an normal combustion engine, it is difficult to atomize a required amount of fuel depending upon changes in load on the engine to finely atomized droplets desirable for combustion in a short time and in large quantities and yet in an effective and efficient manner. Namely, with the Cottell apparatus it is difficult to obtain a great amplitude sufficient for atomizing liquid in large quantities. More specifically, as this apparatus employs a sonic probe formed of a solid member having a large mass, application of such a great amplitude to the sonic probe results in generating too large stresses for materials forming the probe to bear. Furthermore, this apparatus has the disadvantage that it requires a relatively large amount of electric power to atomize the fuel supplied. In the Cornell Apparatus a sonic energy generated by a piezoelectric sonic generator is used to oscillate the sonic probe, the vibrations of the probe being in turn utilized to atomize the fuel supplied to the probe in the atomizing area of the probe. Accordingly when the sonic probe is a solid member having a large mass, as described above, a great amount of sonic energy is required to obtain a great amplitude enough for atomizing the fuel. Hence, a great energy is required to atomize fuel in large quantities. Consequently, the stresses generated in the probe are large to excess, resulting in making it difficult to atomize fuel in large quantities effectively. Moreover, a sonic energy (amplitude energy, for example) transmitted from the piezoelectric sonic generator to the atomizing section of the solid sonic probe to be utilized for atomization of fuel supplied is of substantially the same magnitude as the sonic energy (amplitude energy) initially provided by the piezoelectric sonic generator since the sonic probe is a solid mass, if no account is taken of any attenuation of the energy due to the mass. It cannot thus be said that the sonic energy is utilized effectually and effectively. More particularly, since the amount of energy required to atomize the fuel supplied in the atomizing area of the sonic probe depends upon the effective amplitude of vibration imparted to the fuel fed onto the atomizing section of the sonic probe, as that of the initial sonic energy, as stated above, it cannot be said that the energy from the sonic generator is effectually utilized so as to increase the effective amplitude. The term "effective amplitude" herein used means the amplitude required to atomize liquid, that is, the component of amplitude perpendicular to the plane of the atomizing surface onto which liquid is fed, as expressed by an absolute amplitude X sin $\theta$ where $\theta$ is an angle at which the atomizing surface is inclined to the central axis of the horn Accordingly, it is to be noted that the sonic energy from the sonic generator is not utilized effectively and effectually to atomize the fuel to fine droplets, resulting in an increase in the power consumption for atomization of the fuel, as pointed out above.

Further, as the sonic probe is a solid element, the effect of the mass of the probe on attenuation of the sonic energy is unnegligibly large.

In addition, in the Cottell apparatus mentioned above, as a sleeve nozzle is employed, fuel as supplied cascades down the side wall of the sonic probe to the lower atomizing area, so that there is a large surface contact area between the fuel and sonic probe, resulting in a great power loss.

Furthermore, with the Cottell apparatus, a pool of liquid will grow around the outer periphery of the sleeve adjacent its lower end , so that liquid drops from such grown pool to form coarse droplets. It cannot thus be said that the apparatus is capable of completely atomizing a large quantity of fuel to a fine particle size in an effective manner.

It must also be pointed out that with the Cottell apparatus there would often occur misalignment between the sonic probe and the outer sleeve when assembled together. Once such misalignment has occurred, the pattern of spray formed as the fuel is atomized and thrown outwardly is unbalanced, making it difficult to provide uniform desirable burning conditions.

SUMMARY OF THE INVENTION

Accordingly, the present invention contemplates overcoming the aforesaid problems with the conventional ultrasonic vibratory atomizing apparatus such as the Cottell apparatus, and an object of the invention is to provide an ultrasonic atomizing apparatus which is capable of atomizing liquid material effectively in a short time and in large quantities as required depending upon load variations on an internal combustion engine, for example.

It is another object to provide an ultrasonic atomizing apparatus which is capable of atomizing fuel material to droplets of a uniform and extremely fine particle size.

It is still another object to provide an ultrasonic atomizing apparatus which requires a relatively low electric power consumption to atomize liquid material.

It is yet another object to provide an ultrasonic atomizing apparatus in which the atomizing section of the apparatus may be fed with liquid material effectively from at least one liquid supply mechanism.

It is another object to provide an ultrasonic atomizing apparatus in which compatibility between the atomizing surface of the atomizing section and liquid material supplied to the atomizing section may be varied to further enhance the atomizing property of atomizing the liquid material to droplets having uniform and extremely fine particle sizes.

It is still another object to provide an ultrasonic atomizing apparatus which is capable of atomizing liquid material even if it is fed to the atomizing section of the apparatus in excess of the appropriate design rate of atomization.

It is yet still another object to provide an ultrasonic atomizing apparatus in which the liquid material as fed to the atomizing section of the apparatus is not liable to be disturbed by the flow of combustion air as it enters towards the atomizing section and in which the formation of coarse droplets due to coacence of atomized droplets which may deteriorate the atomizing property is avoided.

It is another object to provide an ultrasonic atomizing apparatus in which the resonance conditions may be improved by enhancing the cooling effect on the atomizing section of the apparatus which is fed with liquid material.

It is still another object to provide an ultrasonic atomizing apparatus which is easy to assemble and handle.

The foregoing objects may be accomplished by the ultrasonic atomizing apparatus according to the present invention.

Briefly, this invention consists in an ultrasonic atomizing apparatus including an ultrasonic vibration generating means, and an ultrasonic vibrator horn connected at one end to said ultrasonic vibration generating means and having the other end portion flared and enlarged in diameter towards the tip end of the horn, said apparatus being adapted to atomize liquid material on said flared portion as the liquid material is supplied from liquid supply means to the flared portion, characterized in that a hollow recess is formed in the flared portion, said hollow recess opening towards the tip end of the horn, the geometry of said hollow recess being such that the hollow recessed section of the horn has an approximately constant area of transverse cross-section taken in any plane perpendicular to the axis of the horn. That is, the cross-sectional area of the annulus obtained by taking a transverse cross-section of the horn in any plane perpendicular to the axis of the horn is the same as the cross-sectional area of the annulus obtained by taking a transverse cross-section of the horn in all other plates perpendicular to the axis of the horn.

It has been found that the aforesaid problems with the conventional apparatus can be eliminated by forming a generally conical hollow recess in the flared portion of the horn as in the present invention. More specifically, the ultrasonic atomizing apparatus according to this invention is reduced in mass as compared to the conventional apparatus provided with a solid sonic probe having a great mass and makes it possible to effect 'flexural' vibration of the horn as will be explained later in detail, whereby liquid material may be atomized to fine droplets on the flared portion of the ultrasonic vibrator horn with a reduced amount of vibrational energy in contrast to the conventional apparatus. It should here be noted that the occurrence of 'flexural' vibration in the ultrasonic vibrator horn of this invention is not found in the sonic probe of the conventional apparatus and that the occurrence of flexural vibration and the reduced mass of the vibrator horn make it possible for the ultrasonic atomizing apparatus of the present invention to atomize liquid material to finer droplets and in larger quantities than the conventional ultrasonic atomizing apparatus.

While a great energy is required for atomization of liquid material with the conventional apparatus such as the Cottell's, the ultrasonic atomizing apparatus having a hollow recess is capable of atomizing liquid material with a reduced amount of energy and making full use of the vibrational energy applied on the atomizing surface by effecting flexural vibration.

As a result the present inventors have found that the ultrasonic vibrator horn according to the instant invention requires a less amount of electric power to be supplied to the ultrasonic vibration generating means to provide a predetermined amplitude of vibration to the atomizing surface than the conventional vibrator horn having no hollow recess requires to provide the same amplitude to the atomizing surface having the same surface area. In other words, if a given electric power is applied to the ultrasonic vibration generating means, a greater amplitude of vibration is obtained to atomize liquid material on the atomizing surface of the ultrasonic vibrator horn having a hollow recess according to this invention whereby the liquid material may be atomized to finer droplets and in larger quantities, as compared to the conventional ultrasonic vibrator horn formed of a solid member and having an atomizing surface of the same geometry as that of the instant invention.

As indicated above, with the ultrasonic atomizing apparatus according to this invention a greater amplitude is easily obtained on the atomizing surface as compared to the conventional ultrasonic atomizing apparatus whereby a less electric power consumption is required to provide a given rate of atomization than the consumption which the comparable prior art apparatus requires to provide the same rate of atomization. Stated another way, if the power supply is of the same level, the ultrasonic atomizing apparatus of this invention is capable of atomizing a larger amount of liquid material to finer droplets than the conventional atomizing apparatus.

As a result, the ultrasonic atomizing apparatus of the present invention, when employed as a fuel injector for an internal combustion engine, may not only make quick response to load variations which requires a large quantity of fuel, but also provide desirable burning conditions in the combusting chamber of the internal combustion engine by atomizing liquid fuel to finer droplets.

Further, stresses in the atomizing section of the flared portion of the ultrasonic atomizing apparatus according to the present invention are reduced and the amplitude required to atomize liquid material is lowered by employing the 'flexural' vibration described above since said hollow recessed section has a substantially constant cross-sectional area in any transverse plane. The present apparatus, coupled with the 'flexural' vibration and the reduced mass of the vibrator horn, makes it possible to atomize liquid material in a large quantity with a reduced amount of energy input, so that the flared portion of the instant ultrasonic atomizing apparatus is required to bear only small stresses in contrast to the conventional apparatus which is subjected to greater stresses. Accordingly, the construction of the atomizing apparatus is advantageous with respect to the strength of material. The vibrator horn according to this invention may thus be formed of any suitable one selected from a number of materials including not only titanium, stainless steel, copper, aluminum and alloy thereof but also ceramics.

In a preferred embodiment of the invention, the transverse cross-sectional area of said ultrasonic vibrator horn in any plane perpendicular to the longitudinal axis of the horn must be approximately constant from the stand-point of the strength of material, that is, to avoid stress concentration. The aforesaid advantages of the present invention may be enjoyed even if the transverse cross sectional area varies in the range of ±40% with respect to said approximately constant area of cross section. Preferably, a wall thickness of said hollow recessed section at the tip end thereof is equal to or less than 20% of the radius of the flared portion at the tip end thereof whereby radial vibration may tend to occur with respect to the vibration axially applied to thereby produce 'flexural' vibration. Formation of such hollow recess is not taught in the aforesaid patent to Cottell.

Further, the vibrator horn according to this invention may be arranged such that the tip end of said flared portion provides a maximum vibrational amplitude, whereby the vibration applied may be effectively used to provide for effective atomization of liquid material supplied.

Said flared portion may have a conical or conical-curved (or trumpet-shaped) outer peripheral surface, whereby an effective atomizing surface for atomizing liquid material may be enlarged.

The apical angle of the wall of said hollow recess with respect to the longitudinal axis of the horn may be 0° to 30° greater than the apical angle of the outer peripheral surface of said flared portion, whereby a recess may be easily formed into a conical shape, for example.

In an alternate embodiment of the invention an atomizing zone for atomizing liquid material is defined within a region extending from said small-diameter section to the enlarged-diameter tip end of said flared section, and an area extending over a portion of said atomizing zone and said small-diameter section may be provided with a roughened surface, whereby compatibility between the atomizing surface of the vibrator horn and the liquid material supplied thereto may be improved to provide finer and more uniform size atomized droplets.

In another embodiment said flared portion may be formed at its enlarged-diameter tip end with a flange, whereby the limits of proper atomizing rates may be broadened as compared to those of the apparatus having a flangeless horn.

In still another embodiment the vibrator horn may be formed around the outer periphery of said small-diameter section adjacent to said flared portion with air flow diverting or baffle means to thereby daect and damp the oncoming flow of air flowing towards the enlarged-end of said flared portion, whereby the combustion air being introduced from the outside toward the atomizing surface is prevented from forcing the liquid material supplied to the atomizing surface to flow down beyond the atomizing surface or from disturbing the surface of liquid adhering to the atomizing surface to thereby produce coarse droplets, for example, so that worsening the atomizing property of the horn may be prevented.

In yet another embodiment the vibrator horn may be provided with air inlet passage means adapted to introduce the oncoming air flowing through a gap defined between the vibrator horn and a housing surrounding the vibrator horn into said hollow recess, whereby not only formation of soots around the flared portion may be suppressed, but also the cooling effect on the vibrator horn may be enhanced so that occurrence of a discrepancy in conditions of resonance between the ultrasonic vibration generating means may be prevented.

In yet another embodiment the ultrasonic vibration generating means and said vibrator horn may be detachably connected to each other, and a joint between the vibration generating means and the vibrator horn detachably connected thereto may be arranged so as to lie at a point of maximum amplitude. Further, said hollow recess may be provided with groove means such as an allen wrench engageable socket so that the horn may be easily and effectively assembled and handled without affecting the atomizing property of the apparatus.

In another aspect, the present invention provides an ultrasonic atomizing apparatus including an ultrasonic vibration generating means, and an ultrasonic vibrator horn connected at one end to said ultrasonic vibration generating means and having the other end portion flared and enlarged in diameter towards the tip end of the horn, said apparatus being adapted to atomize liquid material on said flared portion as the liquid material is supplied from liquid supply means to the flared portion, characterized in that a hollow recess is formed in said flared portion, said hollow recess opening towards the tip end of the horn, the geometry of said hollow recess being such that the hollow recessed section of the horn has an approximately constant area of transverse cross-section taken in any plane perpendicular to the longitudinal axis of the horn, liquid supply means having injection nozzle means for feeding liquid material to said flared portion of the horn is oriented at a predetermined angle so as to direct the liquid material against said horn at a feed point at or above a boundary between said small-diameter section and the adjoining flared portion.

The liquid supply means provided with injection nozzles according to the present invention provides more stable spray patterns and supply liquid material consistently from low to high atomizing rates, in contrast to the sleeve nozzle system according to the Cornell apparatus in which liquid material is delivered along the side wall of the sonic probe.

In one embodiment said liquid supply means may be oriented at two or more different predetermined angles so as to direct the liquid material against said flared portion in order to enlarge the effective atomizing surface area.

BRIEF DESCRIPTION OF THE DRAWINGS

Specific embodiments of the invention will now be described by way of example and not by way of limitation with reference to the accompanying drawings, in which:

FIG. 1(*a*) is a graph showing the relation between the input and the amplitude;

FIG. 3(*a*) is a graph showing the relation between the mean particle diameter and the rate of atomization;

DESCRIPTION OF THE PREFERRED EMBODIMENTS

Figure 1:
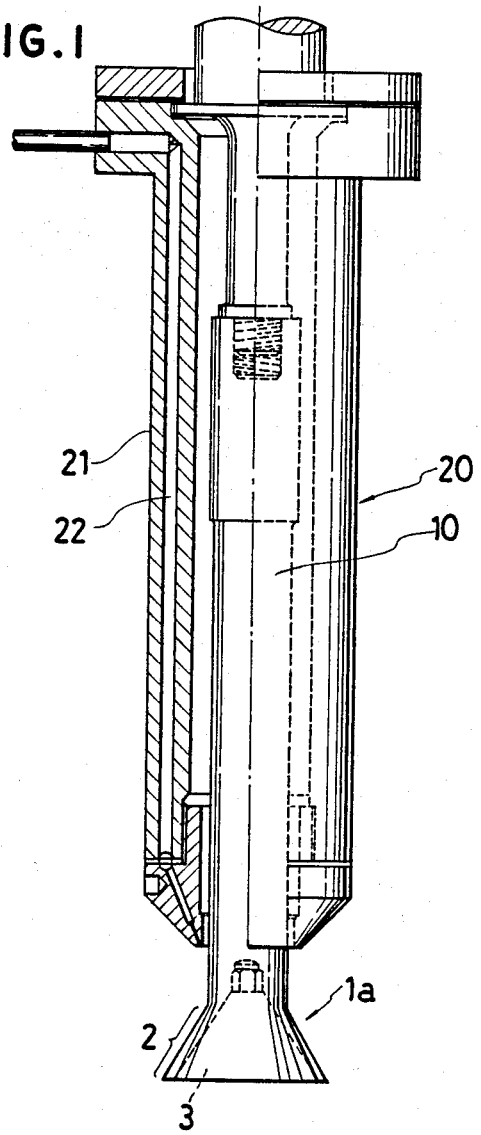
FIG. 1 is a side elevational view, partly in section of the ultrasonic atomizing apparatus according to one embodiment of the invention.
Figure 1A:
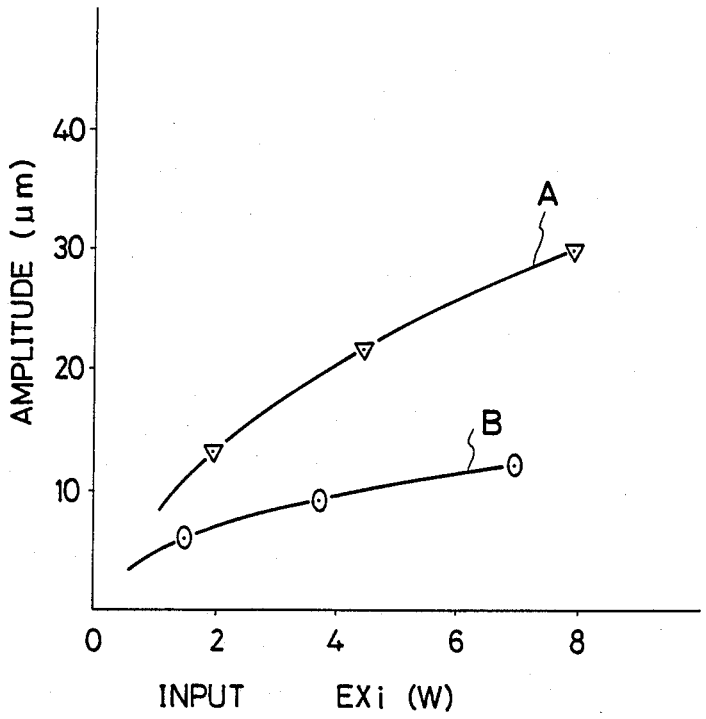

FIG. 1 illustrates an ultrasonic atomizing apparatus 20 according to a first embodiment of the present invention. As stated hereinabove, the ultrasonic atomizing apparatus may be used as a fuel atomizing apparatus for internal combustion engines such as diesel engines and gasoline engines, external combustion engines such as boilers and burners, and other various applications. The ultrasonic atomizing apparatus 20 comprises an ultrasonic vibration generating means composed of an electric acoustic transducer element and a high frequency oscillator for driving the transducer element, an ultrasonic vibrator horn 10 powered by the electric-acoustic transducer element, liquid supply means as in the form of a liquid supply conduit 22 for supplying a liquid material such as liquid fuel to the vibrator horn 10 to be atomized by the horn, and a housing 21 embracing the nozzle of the liquid supply conduit 22 and surrounding the vibrator horn 10, as is well known.

In operation, the ultrasonic vibration generating means is driven by drive means (not shown) to produce ultrasonic waves, which are transmitted to the ultrasonic vibrator horn connected to the ultrasonic vibration generating means while liquid material is supplied from the liquid material supply means to the vibrator horn to flow down the horn to the atomizing region thereof where the liquid material is atomized by the ultrasonic vibrations transmitted to the horn and the atomized droplets are thrown out from the atomizing region to the ambient atmosphere.

The ultrasonic vibrator horn 10 will now be described in detail . As shown in FIG. 1, the vibrator horn 10 has a small-diameter cylindrical section extending the axis of the horn from the end (upper end as viewed in FIG. 1) thereof connected to said electric-acoustic transducer element constructing the ultrasonic vibration generating means and the other end (lower end as viewed in FIG. 1) opposite from the electric-acoustic transducer element enlarged in diameter, with a section between the small-diameter section and the enlarged-diameter end flaring in the shape of a cone. The section flaring in the shape of a cone (hereinafter referred to as "flared portion 1*a*") may take the shape having an outer curved surface, that is, the so called divergent shape or trumpet-shaped configuration.

The boundary between the flared portion 1*a* of the horn 10 and the small diameter section is rounded to a radius to prevent stress concentration on the boundary, and the axial feed line of the liquid discharged from the nozzle of the liquid supply conduit 22 which is the liquid supply means is directed toward a predetermined point adjacent to said boundary. The liquid supply means will be described hereinafter. The outer periphery surface of the flared portion 1*a* of the vibrator horn 10 defines an atomizing surface 2 for atomizing the liquid material discharged from the nozzle of the liquid supply conduit 22.

According to the present invention, as shown in FIG. 1, a hollow recess or cavity 3 is formed in the vibrator horn 10, said recess opening towards the enlarged tip end of the horn and extending axially through the flared portion 1*a* and partially into the small-diameter section.

Figure 2:
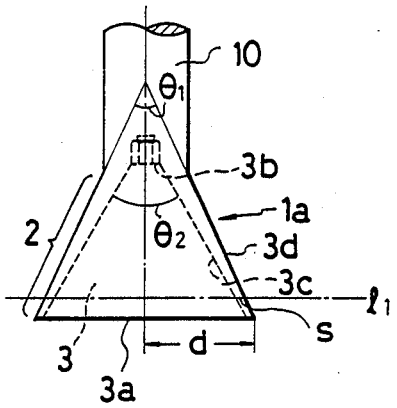
FIG. 2 is an enlarged view of a portion of the apparatus shown in FIG. 1.

Referring to FIG. 2, the details of the hollow recess 3 will be described. In order to obtain maximum amplitude of vibration at the tip end 3*a* of the vibrator horn 10 the geometry of the hollow recess 3 in the present apparatus is such that the end 3*a* (lower end as viewed in FIG. 1) of the vibrator horn 10 opposite from the electric-acoustic transducer element lies at a point of maximum amplitude. In this arrangement the recess 3 is so shaped and sized that the annular cross-sectional area S of the hollow recessed section taken in any plane $1_1$ perpendicular to the longitudinal axis of the vibrator horn 10 and defined between the inner periphery 3*c* and the outer periphery 3*d* of the hollow recessed section either decreases progressively from the inner end 3*b* to the tip end 3*a* or is approximately constant. The cross-sectional area S may be varied in the range of ±40% with respect to said substantially constant value.

A convenient method of forming the hollow recessed section having a cross-sectional area S as stated above is to form a conical hollow recess 3 so that the apical angle $\theta_2$ defined by the wall of the conical recess, that is, the inner periphery 3*c* inclined toward the axis of the horn 10 is 0° to 30°, preferably 5° to 10° greater than the apical angle $\theta_1$ defined by the outer periphery 3*d* of the flared portion 1*a* inclined toward the axis of the horn 10.

Further there is no substantial difference in the performance of the ultrasonic vibrator horn of the present invention regardless of whether the flared portion of the horn has a conical configuration or a truxet-shaped configuration. When the horn has a flared portion formed in a trumpet-shaped configuration, as viewed in FIG. 7(*d*) which will be described in more detail later, the angle defined by two tangent lines $m_1$ and $m_2$ each touching the flared portion at the center thereof (that is, at the middle point of the outer periphery surface of the flared portion extending over the end adjacent to the small-diameter section of the horn and the tip end of the flared portion) and extending to the axis of the horn is used as the apical angle of the horn, which preferably is an angle in the range of 30° to 60° as in the horn having a flared portion formed in a conical configuration.

Further, the wall thickness of the hollow recessed section defined between the inner periphery 3*c* and the outer periphery 3*d*, that is, the wall thickness of the flared portion 1*a* is no greater than 20% of the radius d of the flared portion at the enlarged-diameter end 3*a* in order to facilitate the vibration of the flared portion 1*a* in a radial direction as described later.

As noted hereinabove, it has been found that owing to the hollow recess or cavity 3 formed through the flared portion of the vibrator horn 10 from the enlarged-diameter end and into the small-diameter section, the vibrator horn 10 according to the first embodiment of the invention requires less electric power provided to the ultrasonic vibration generating means to obtain a predetermined amplitude of vibration over the atomizing surface 2 than the comparable prior art vibrator horn devoid of any hollow recess and having an atomizing surface of the same geometry as that of the instant atomizing surface 2, as is clearly seen from the graph of FIG. 1(*a*) showing the relation of the amplitude (ordinate axis) to the electric power input (abscissa axis) in which the curve A represents the vibrator horn of the present invention while the curve B represents the conventional vibrator horn. In other words, for a given amount of electric power supply to the ultrasonic vibration generating means, the ultrasonic vibrator horn 10 having a hollow recess 3 formed therein is able to provide a greater amplitude on the atomizing surface than the conventional vibrator horn devoid of such recess and having an atomizing surface of the same shape and size as that of the horn of this invention.

This means that the ultrasonic vibrator horn 10 of the present invention requires a less electric power consumption to provide a given rate of atomization than the consumption required by the prior art vibrator horn devoid of a recess to provide the same rate of atomization as said given rate. Stated differently, for a given electric power supply the ultrasonic vibrator horn 10 according to the instant invention is able to atomize a greater quantity of liquid material than the prior art ultrasonic vibrator horn.

In addition, the ultrasonic vibrator horn 10 is capable of providing a great amplitude of vibration required to effectively atomize liquid material to very fine particles. Thus, since a greater amplitude is easily obtained on the atomizing surface 2 as compared to the conventional horn, the vibrator horn of this invention is able not only to atomize liquid material to finer particle size but also to atomize liquid in large quantities.

More specifically, the mass of the ultrasonic vibrator horn is reduced by forming a hollow recess 3 therein whereby the vibrational energy required to vibrate the vibrator horn 10 so as to atomize liquid material supplied on the atomizing surface 2 of the horn is correspondingly reduced.

Furthermore, the atomizing zone 2 has some flexibility due to its reduced wall thickness and the arrangement is such that the end 3*a* of the atomizing surface 2 is at a point of maximum amplitude so as to provide a maximum amplitude. The vibrational energy from the ultrasonic vibration generating means is transmitted both in a direction axial of the vibrator horn 10 and in direction along the atomizing surface 2 (generally radial or transverse direction) inclined at an angle with the axial direction to produce compound vibration on the atomizing surface 2 (which compound vibration is termed "flexural vibration" herein). This 'flexural' vibration facilitates a great amplitude on the atomizing surface 2, so that a great amplitude of the flexural vibration serves as an effective amplitude required to atomize liquid material. Thus, the flexural vibration acts very effectively not only to atomize the liquid material fed to the atomizing surface 2 into fine droplets but also to atomize a large amount of liquid material easily, resulting in a decrease in the electric power requirements.

Owing to the flexural vibration, the effective amplitude on the atomizing surface 2 required to atomize liquid material to fine droplets is augmented, so that for a given amount of vibrational energy imparted to the atomizing surface, the ultrasonic atomizing apparatus is capable of atomizing a great amount of liquid material to much finer particles than the prior art ultrasonic atomizing apparatus. It is to be noted here that the effective amplitude useful to atomize liquid material is the component of amplitude in a direction perpendicular to the plane of the atomizing surface, rather than the absolute amplitude. The effective amplitude is expressed by the absolute amplitude X sin $\theta$.

In other words, the flexural vibration increases the effective amplitude on the atomizing surface, which acts effectively to atomize liquid to very fine droplets and in large quantities whereby the longitudinal amplitude may be reduced to atomize a given amount of liquid material, resulting in a decrease in the stress exerted on the vibrator horn and hence widening the range of selection of suitable materials of which the vibrator horn may be made from a viewpoint of material strength. Furthermore, since the annular cross-sectional area of the flared portion 1*a* defining the atomizing surface and having the hollow recess 3 is substantially constant in any transverse plane taken across the flared portion, no stress concentration occurs, which is desirable from a viewpoint of material strength. By way of example, it has been found that the ultrasonic vibrator horn according to the present invention exhibits satisfactory durability without impairing even if it is constructed of aluminum in place of titanium of which the conventional vibrator horn was typically made.

In addition, as noted above, the effective amplitude useful to atomize liquid material is not the absolute amplitude, but the transverse amplitude component perpendicular to the plane of the atomizing surface as expressed by the absolute amplitude X sin $\theta$, and thus the prior art atomizing apparatus requires a greater amplitude from the ultrasonic vibration generating means to atomize liquid material. Owing to the flexural vibration which produces relatively greater transverse amplitude component, the present ultrasonic atomizing apparatus generates the effective amplitude available for atomization of liquid material more effectively in contrast to the prior art atomizing apparatus. Consequently, even if the conical flared section 1*a* of the vibrator horn has a relatively small apical angle, the present apparatus has made it possible to effect atomization of liquid material by a relatively small amplitude from the ultrasonic vibration generating means.

The 'flexural' vibration will now be explained in greater detail with reference to FIG. 3 which shows an enlarged view of a portion of the flared section of the ultrasonic vibrator horn 10. When at rest before energization, the tip end of the flared section of the horn 10 is at a position (a). When retracted in operation, the tip end of the horn is at a position (a'). When extended in operation the tip end is at a position (a''). It is seen from FIG. 3 that the radius (d) of the horn 10 at its tip end is increased when retracted while it is decreased when extended. It is thus to be understood that transversal vibration in a radial direction with respect to the axis of the vibrator horn 10 is induced and imparted to the atomizing surface 2 of the horn in addition to the longitudinal vibration which is applied from the ultrasonic vibration generating means and causes the normal absolute amplitude, whereby the atomizing surface 2 is subjected to the compound vibration composed of these two vibrations, that is, the 'flexural' vibration. As stated hereinabove, the occurrence of the flexural vibration augments the effective amplitude to thereby facilitate atomizing liquid material supplied to the atomizing surface 2 to fine droplets and in large quantities.

Figure 3:
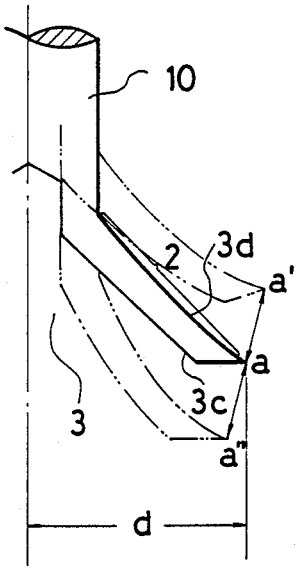
FIG. 3 is a diagramatical view of a portion of the vibrator horn of the apparatus illustrating the 'flexural' vibration.
Figure 3A:
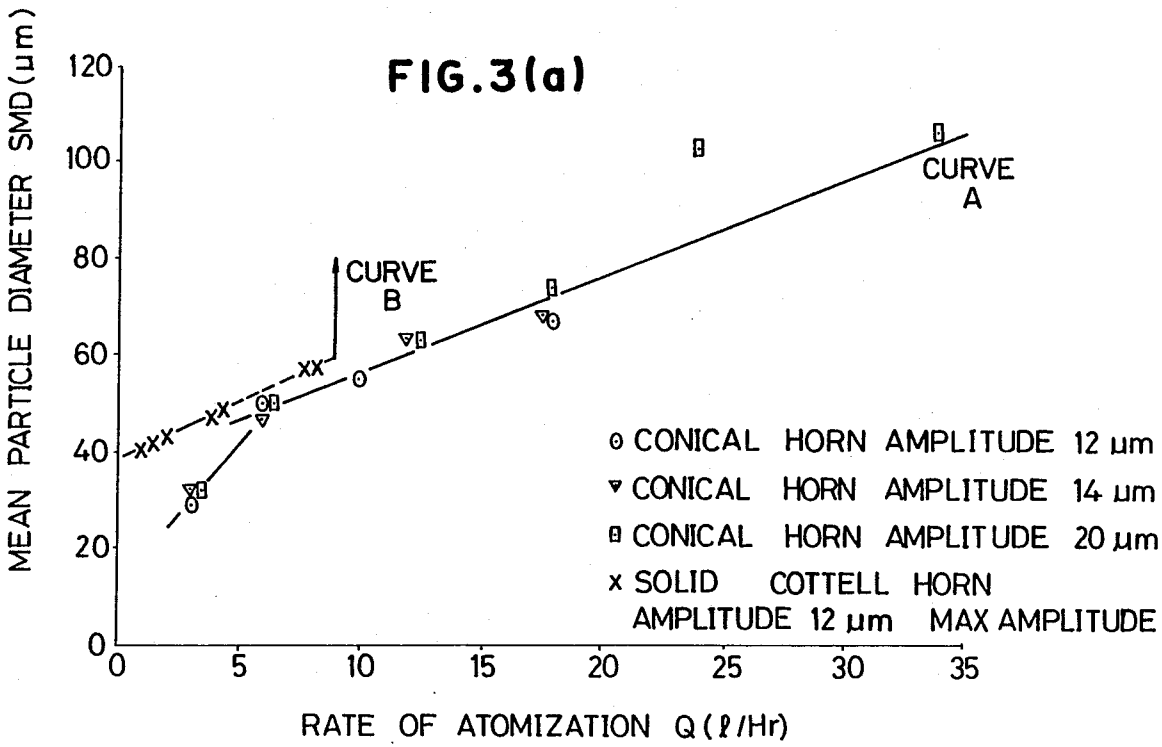

FIG. 3(*a*) is a graph showing the relation of the rate of atomization to the average droplet size provided by the ultrasonic atomizing apparatus according to the present invention in comparison with the prior art apparatus. In FIG. 3(*a*), the abscissa axis expresses the average droplet size or mean particle diameter while the ordinate axis is used to show the rate of atomization. The curve A represents the atomizing apparatus according to the present invention while the curve B represents the conventional apparatus. As is apparent from the graph of FIG. 3(*a*), the present ultrasonic atomizing apparatus provides smaller average droplet sizes and much higher rates of atomization (see the permissible maximum rate of atomization) than the conventional apparatus.

Figure 4:
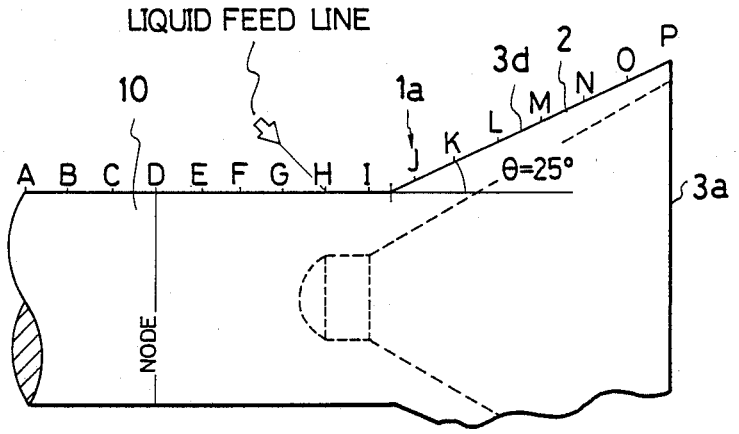
FIG. 4 is a fractional side view of the forward end portion of the horn.

The effective amplitude on the atomizing surface 2 of the present ultrasonic atomizing apparatus will be further described with reference to FIG. 4 illustrating portions of the flared portion 1*a* and small-diameter section of the ultrasonic vibrator horn 10 according to one embodiment of the present invention in which arbitrary points P, O, N, M, L, K, J, I, H, G, F, E, D, C, B and A spaced axially along the outer periphery 3*d* of the flared portion 1*a* from the tip end 3*a* to the small-diameter section are shown. As noted above, the effective amplitude is a component of amplitude in a direction perpendicular to the plane of the atomizing surface 2 as expressed by the absolute amplitude of longitudinal vibration X sin $\theta$.

In the illustrated embodiment the outer periphery 3*d* is inclined at an angle of about 25° with respect to the axis of the ultrasonic vibrator horn 10 and liquid material as discharged from the nozzle of a liquid supply means as will be described later is directed at the point H on the horn 10 at an angle between 15° and 75°.

Figure 5:
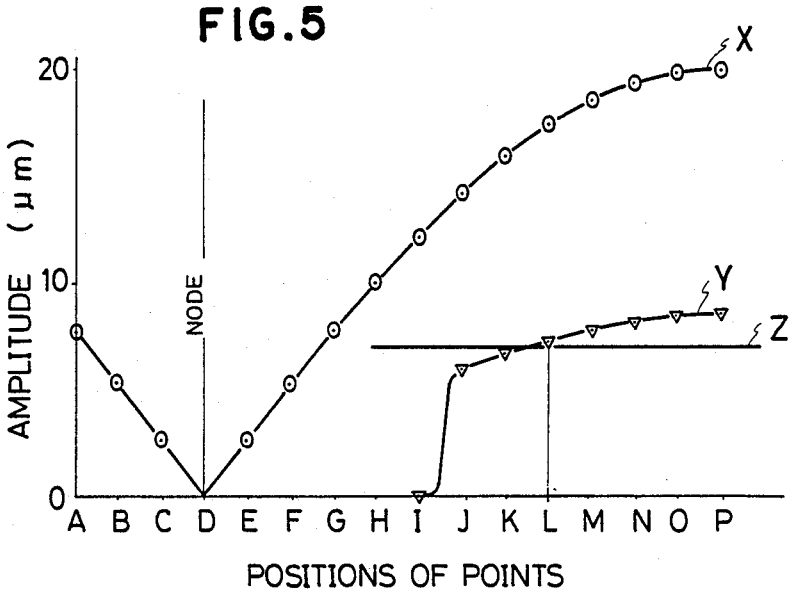
FIG. 5 is a graph showing the relation between the various points shown in FIG. 4 and the amplitude.

The effective amplitudes on the various points A–P are shown in the graph of FIG. 5 in which the amplitude is taken on the ordinate axis while the points A–P are shown on the abscissa axis. In FIG. 5 the curve X represents the amplitude of longitudinal vibration imparted to the vibrator horn the node of which is at the point D. With such longitudinal vibration given, the effective amplitude represented by the curve Y rises abruptly at the point J and then gradually increases up to the point P at the tip end where the effective amplitude is maximized.

The straight line Z extending horizontally across the curve Y defines a boundary line above which the effective amplitudes are able to provide atomization of liquid and below which the effective amplitudes are unable to atomize liquid. As is apparent from FIG. 5, in the present embodiment effective atomization of liquid material takes place over a zone extending from approximately the point L to the point P.

Occurrence of the flexural vibration on the atomizing surface 2 as described hereinbefore provides extremely great advantages. For example, the ultrasonic atomizing apparatus requires a reduced amount of vibrational energy from the ultrasonic vibration generating means to atomize a given quantity of liquid material as compared to the comparable conventional ultrasonic atomizing apparatus having no hollow recess formed in its vibrator horn. It follows that the present apparatus requires a less electric power consumption and that for a given power consumption it provides for atomization of a larger amount of liquid material than the prior art ultrasonic atomizing apparatus. Consequently, it is possible to effect atomization of liquid material with a smaller amplitude, hence a reduced vibrational energy supply from the ultrasonic vibration generating means to the atomizing surface 2, whereby stresses exerted on the vibrator horn may be reduced, resulting in broadening the range of selection of materials of which the vibrator horn is formed from a viewpoint of material strength. If a given level of vibrational energy having a given amplitude is provided from the ultrasonic vibration generating means to the atomizing surface 2, the atomizing apparatus according to this invention is capable of atomizing liquid material with a greater effective amplitude, that is, a greater vibrational energy due to the 'flexural' vibration on the atomizing surface 2, and thereby atomizing the liquid material to finer particle size.

The table 1 below shows comparative vibration characteristics of an example A of the ultrasonic vibrator horn according to the present invention and the prior art vibrator horn B devoid of a hollow recess.

TABLE 1

Vibration Characteristics of Vibrator Horns

| Type of horn | Length of horn l(mm) | Resonant frequency f(KHz) | Input amplitude $x_1$(μm) | Longitudinal amplitude at tip end (one way) $x_2$(μm) | Transverse amplitude at tip end (one way) y (μm) | Absolute amplitude (one way) D (μm) | Longitudinal amplitude amplification αx | Maximum stress $\sigma_{max}$(kg/mm$^2$) |
|---|---|---|---|---|---|---|---|---|
| | Items analyzed | | | | | | | |
| Horn A | 187.0 | 38.36 | 1.36 | 12.5 | 4.6 | 13.3 | 9.19 | 6.88 |
| Horn B | 187.0 | 37.78 | 4.65 | 12.5 | 0 | 12.5 | 2.69 | 23.3 |

A: Horn of the present invention
B: Conventional horn
Input amplitude: Applied amplitude
Absolute amplitude: Resultant amplitude of longitudinal amplitude and transverse amplitude
Amplification of longitudinal amplitude: $x_2/x_1$ As is clearly seen from the Table 1, when an input amplitude which causes a longitudinal amplitude of 12.5 μm (one way) at the tip end of the horn is applied to horns A and B, the absolute amplitude of the conventional horn B is just the same as the longitudinal amplitude of 12.5 μm and no transverse (radial) amplitude generates in the horn B, which indicates that no substantial flexural vibration is produced in the horn B. In contrast, the horn A of the present invention exhibits an absolute amplitude of 13.3 μm and a transverse amplitude of 4.6 μm. It is thus to be noted that flexural vibration is considerably generated in the horn A.

Further, the Table 1 shows that the longitudinal amplitude amplification, that is, the amplification ratio of the longitudinal amplitude to the input amplitude, of the conventional horn B is 2.69 whereas the longitudinal amplitude amplification of the horn A of the present invention is 9.19. This means that it has been made possible to very efficiently obtain a greater emplitude with the horn according to the present invention.

It is also seen from the Table 1 that the maximum stress generated in the horn B is 23.3 kg/mm$^2$ whereas that of the horn Aof the present invention is 6.88 kg/mm$^2$ which is about one-third of the maximum stress generated in the conventional horn B. It is to be appreciated that the ultrasonic vibrator horn according to the present invention is desirable from a view point of material strength as well in that the maximum stress generated in the horn of the present invention is much less than that generated in the conventional horn having no hollow recess as stated above.

Figure 6:
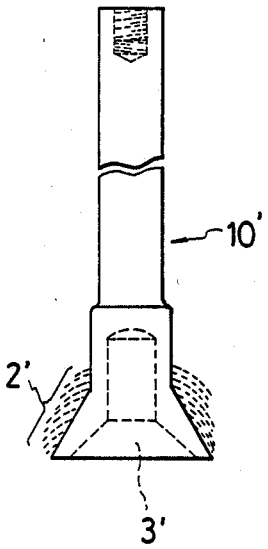
FIG. 6 is a schematic side elevational view of the vibrator horn according to another embodiment of the invention.

FIG. 6 illustrates an ultrasonic vibrator horn 10' according to another embodiment of the invention modified from the construction shown in FIG. 1, in which a generally cylindrical portion immediately upstream of the flared section where a cavity or recess 3' is formed is enlarged in diameter as shown in FIG. 6 in order to increase the area of the atomizing surface 2' for atomizing liquid material. As is seen from FIG. 6, the area of the atomizing surface 2' may be enlarged by increasing the diameter of a portion immediately upstream of the flared section to thereby atomize liquid material to finer droplets and in large quantities. More specifically, an increase in the atomizing surface area reduces the rate of atomizing liquid material supplied per unit area of the atomizing surface, whereby the vibrational energy imparted to the liquid material is augmented, making it possible to atomize the liquid material to finer particles and in larger quantities.

The apical angle of the conical flared section of the ultrasonic vibrator horn according to the present invention as shown in FIGS. 1 and 6 will be described below.

When the ultrasonic atomizing apparatus is employed as an atomizer in an intake manifold of an internal combustion engine such as a gasoline engine for example, the apical angle of the flared section of the vibrator horn should be set at an value within an appropriate range in order to prevent a large amount of atomized droplets from adhering to the wall of the intake manifold, namely to prevent atomized droplets from scattering around over an excessively wide angle.

However, when the outer periphery of the flared section has a small apical angle, it is quite difficult to produce a great amplitude required to effect atomization, as will be apparent in view of the mechanism by which the effective amplitude is generated. Even if such great amplitude could be obtained, excessive stresses would be exerted on the flared section and the small-diameter section, causing a problem in the aspect of the material strength. In view of this the apical angle of the flared section of the horn according to this invention should be in a limited range in order to produce a flexural vibration and utilize the effective amplitude efficiently to atomize liquid material supplied to finer droplets and in large quantities.

Figures 7A, 7B, 7C:
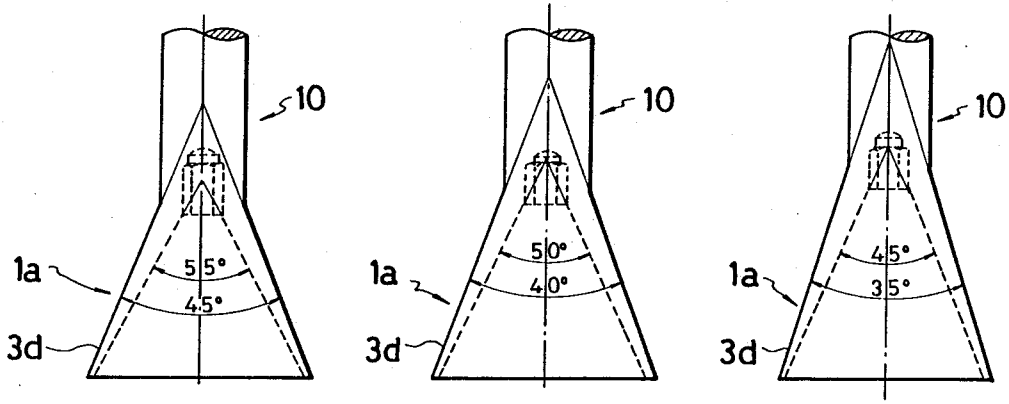
FIGS. 7(*a*)–7(*d*) are schematic side elevational views of vibrator horns according to the invention having various apical angles.
Figure 7D:
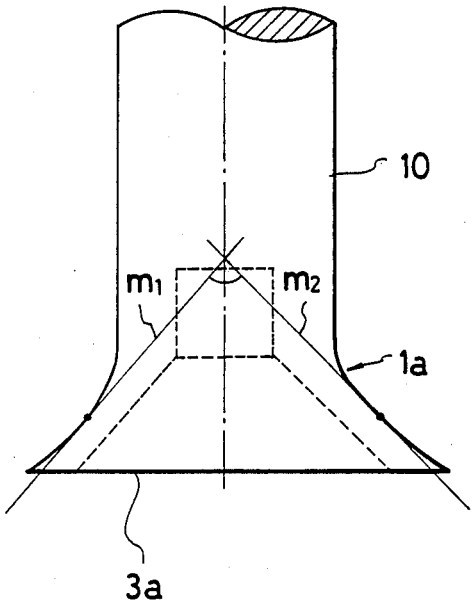

As illustrated in FIGS. 7(*a*), 7(*b*) and 7(*c*), it has been found that the apical angle of the flared portion 1*a* of the horn 10 is preferably in a range from about 30° to about 60°, and more preferably in a range from about 30° to about 45°, in order to generate an effective amplitude desirable to provide atomization of liquid material into fine droplets and in large quantities, whereby desirable spray patterns may be obtained without the droplets excessively adhering to the wall of the intake manifold and hence without impairing the response of the internal combustion engine to the supply of liquid fuel.

In addition, the ultrasonic vibrator horn according to the present invention having a relatively large apical angle is capable of atomizing the liquid material deposited on the atomizing surface even in a thicker liquid film since such horn provides a greater effective amplitude. Thus, under the same operational conditions such as the amplitude, the rate of treating liquid for atomization and the flow rate of liquid delivery, upon reaching the horn surface the liquid is atomized immediately even in a thicker film but with a correspondingly larger droplet size on the horn having a greater apical angle.

On the contrary, with the vibrator horn having a smaller apical angle, the liquid travels along the flared portion of the horn a long distance until it spreads out into a thin liquid film before it can be atomized to finer droplets, since the maximum thickness of the liquid film deposited on the atomizing surface that the horn with a smaller apical angle can atomize is less because of a reduced effective amplitude available for atomization of liquid.

It is thus to be understood that the smaller the apical angle of the flared section, the greater the effective atomizing surface area is and the less the amount of liquid per unit area the horn can atomize. This means that with a smaller apical angle it is possible to atomize liquid material by a relatively low vibrational energy applied to the liquid material.

Accordingly, if a large amount of liquid material is to be handled, it is preferable from a viewpoint of the effective atomizing surface area that the flared portion be provided with a smaller apical angle. It will be also appreciated that as stated above, the apical angle of the flared section preferably in a range from about 30° to about 60°, and more preferably from about 30° to about 45° in order to produce a flexural vibration according to the present invention and to make effective use of the effective amplitude to provide atomization of liquid to finer droplets and in greater quantities. In the embodiments described above the ultrasonic vibrator horn has the flared portion having an outer periphery surface formed in a conical shape, the present invention is also realized by the horn having a flared portion with a trumpet-shaped outer periphery surface.

The flared portion having such conical curved or trumpet-shaped outer periphery surface, as shown in FIG. 7 (*d*), is arranged such that the outer periphery surface extending over the small-diameter section and the enlarged end provides a curved surface as viewed in a cross-section view taken along the axis of the flared portion. It has been found that the angle of the tangent lines $m_1$ and $m_2$ each touching the outer periphery surface of the flared portion at the center thereof and extending toward the axis of the ultrasonic vibrator horn, that is, the apical angle of the flared portion is preferably in the range of 30° to 60° as that of the horn having the conical flared portion as described above.

The liquid supply means for supplying liquid material to the ultrasonic vibrator horn will next be described.

Figure 8A:
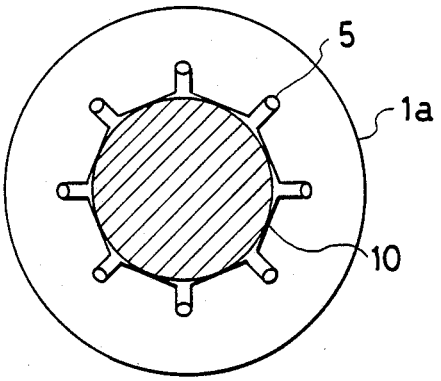
FIG. 8(*a*)–8(*c*) illustrate the manner in which the vibrator horn according to the invention is supplied with liquid material.
Figure 8B:
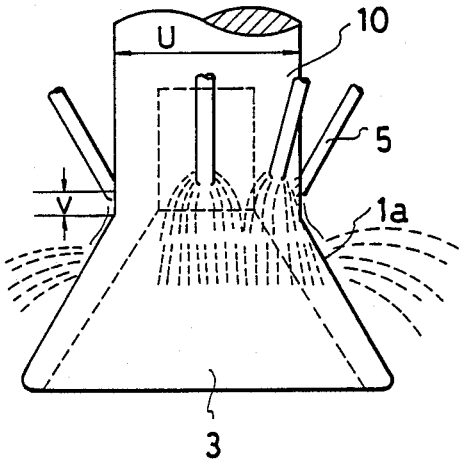
Figure 8C:
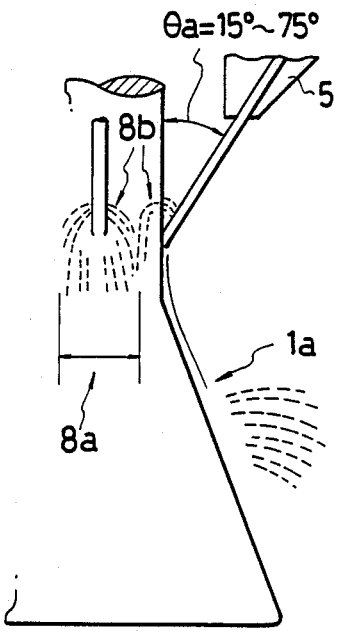

FIGS. 8(*a*), 8(*b*) and 8(*c*) show liquid supply means for feeding liquid material to the ultrasonic vibrator horn 10 according to the present invention.

Typically, the liquid supply means includes one or more nozzles 5 (eight nozzles in the illustrated embodiment) spaced from the outer peripheral surface of the small-diameter section of the horn 10 slightly above the boundary between the small-diameter section and the adjoining flared portion 1*a*. Preferably, the feed point on the vibrator horn against which the liquid from the nozzles 5 is discharged is positioned slightly above said boundary, as seen in FIG. 8(*c*).

The feed point may be preferably positioned such that the ratio V/U is in a range from 0 to 1, where U is the diameter of the small-diameter section and V is the distance from said boundary to the feed point above the boundary (see FIG. 8(*b*)). Within this range, it is possible to cause the liquid material to flow down the small-diameter section towards the flared section 1*a* in a liquid film, so that a uniform film of liquid desirable for atomization may be formed on the atomizing surface. The ultrasonic vibrator horn 10 according to this invention is thus able to operate satisfactorily to atomize the liquid material.

On the contrary, if the liquid material from the supply means is discharged directly against the flared portion 1*a* which is intensively vibrating, the liquid material cannot form a uniform film over the atomizing surface of the flared portion but can be bounced off from the atomizing surface as coarse unatomized droplets.

Thus, the nozzle 5 should be positioned above the boundary between the smaller-diameter section and the adjoining flared portion at a predetermined oblique angle $\theta_a$ such that the liquid feed point is on or above said boundary (the ratio V/U=0 to 1). Furthermore, the liquid material may be fed to a point below the boundary, that is, the flared portion depending upon the flow rate of the liquid material, and the type, viscosity and surface tension of the liquid material.

The angle $\theta_a$ at which the liquid is directed against the outer peripheral surface of the small-diameter of the horn 10 from the nozzle 5 is preferably in a range from 15° to 75° as shown in FIG. 8(*c*). Such preferable range of the angle $\theta_a$ varies somewhat depending upon the size of the nozzle orifice, the flow rate of the liquid delivery, and the type, viscosity and surface tension of the liquid material. Experiments on the feeding angle $\theta_a$ using gasoline, kerosene, diesel oil, and other liquid materials in slurry have shown that the aforesaid range of the angle is preferable for the purpose of this invention.

If the liquid feeding angle $\theta_a$ is excessively small, the spreading width 8*a* (see FIG. 8(*c*)) of the liquid becomes small, requiring that the number of liquid discharge nozzles 5 be increased in order to spread the liquid sufficiently over the atomizing surface 2 to utilize the atomizing surface effectively for atomization of the liquid. Furthermore, the velocity of the liquid discharged from the nozzle is not sufficiently decelerated upon hitting the horn, which adversely affects the atomizing conditions on the atomizing surface.

On the contrary, if the liquid feeding angle $\theta_a$ is too large, excessive splashing of liquid material or formation of excessively large beads 8*b* of liquid material may result upon the liquid hitting the horn, which may cause liquid material to fall in drops in a horizontal orientation.

The use of the injection nozzle as described above with the liquid supply means makes it possible to provide stable spray patterns as well as to supply liquid material consistently from low to high flow rates.

Other embodiments of the ultrasonic atomizing apparatus according to the present invention as described above will now be described.

Figure 9:
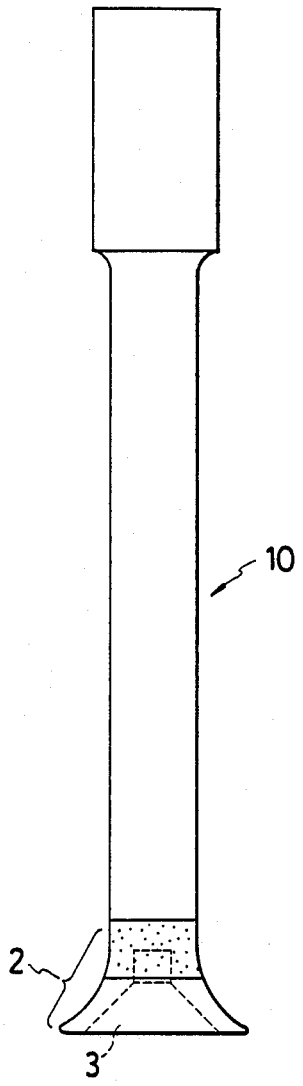
FIG. 9 is a side elevational view of a vibrator horn according to another embodiment of the invention.

FIG. 9 illustrates another embodiment of the ultrasonic vibrator horn according to the present invention in which a region of the small-diameter section and the adjoining flared portion of the horn 10 including a portion of the atomizing zone are provided with roughened surfaces by sandblasting. As is seen from FIG. 10 it has been found that the roughened surface in this region is more useful to provide atomized droplets of more uniform and smaller particle sizes to thereby further enhance the atomizing property of the horn over a range of low to medium rates of atomizing, due to the relation between the compatibility of the liquid material supplied from the liquid material supply means with the metal surface defining the atomizing area and the atomizing property of the horn.

Figure 10:
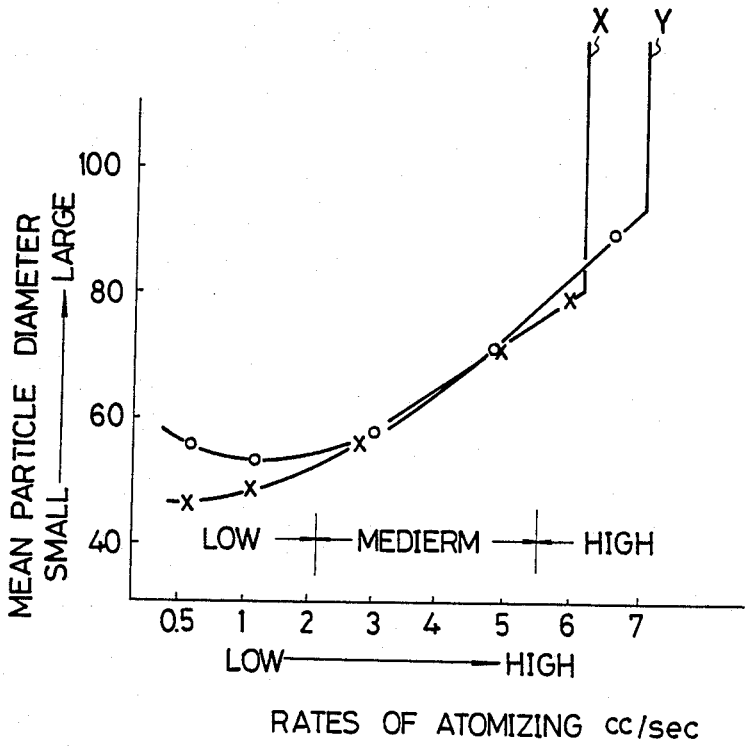
FIG. 10 is a graph showing the mean particle diameter and the rate of atomizing on the vibrator horn having a roughened atomizing surface.

In the graph of FIG. 10, the ordinate axis is used to show average droplet sizes or mean particle diameters while the abscissa axis is taken to show the rates of atomizing. The curve X represents the ultrasonic atomizing apparatus of the present invention having a vibrator horn subjected to sandblasting whereas the curve Y represents the ultrasonic atomizing apparatus of the present invention having a vibrator horn subjected to polishing treatment. In the embodiment of FIG. 9 the sandblasting process was carried out by blowing sand or metal particles (#600 mesh) against the surface being treated from an air gun for several seconds to several minutes. The thus roughened surface was observed under an optical microscope (reflection type). The roughness (Ra) of the surface(as specified by JISB0601) measure by a roughness measuring instrument was in a range from 2 μm to 6 μm.

Figure 11:
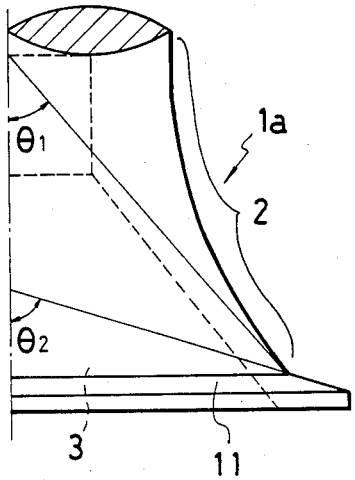
FIG. 11 is a side elevational view of a vibrator horn according to still another embodiment of the invention.
Figure 12:
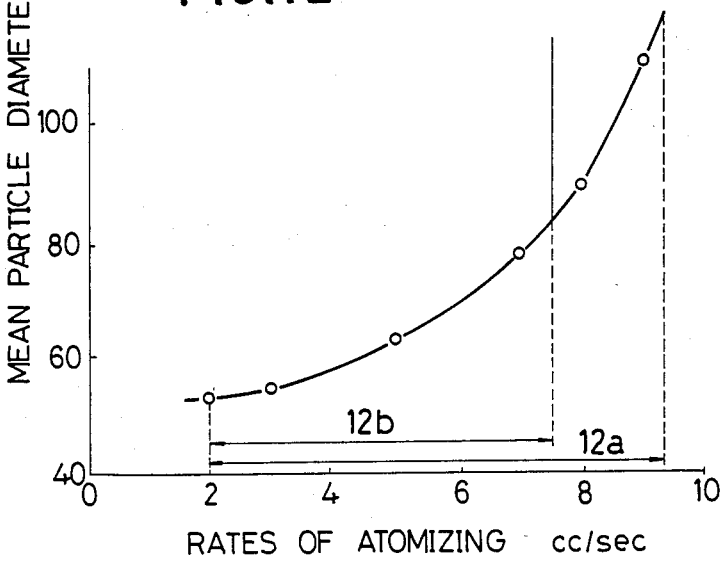
FIG. 12 is a graph showing the relation between the mean particle diameter and the atomizing rate on the vibrator horn having a flange at the tip end.

FIG. 11 shows still another embodiment of the ultrasonic vibrator horn according to the present invention in which the flared portion of the horn 10 is formed at its enlarged diameter (say 32 mm) tip end with a flange 11 having a slope angle $\mu_2$ of the outer peripheral surface of the flange with respect to the longitudinal axis of the horn, which is 80°, for example. The slope angle $\theta_1$ of the atomizing surface of the flared portion with respect to the horn axis is 30°, for example. As shown in the graph of FIG. 12 in which the ordinate axis is used to express the average droplet sizes or mean particle diameters while the abscissa axis is taken to express the rates of atomizing, it has been found that the flange-less vibrator horn provides a range **12*b* of limits of atomizing rates at which the liquid material is atomized on the atomizing surface whereas the flanged vibrator horn provides a broadened range 12*a* of limits of atomizing rates exceeding the range 12*b*** of limits of atomizing rates, resulting in an increased atomizing amount. In this embodiment of the present invention it is required to maintain the relation between the slope angles $\theta_1$ and $\theta_2$ in $\theta_2 > \theta_1$, as illustrated above.

Figure 13:
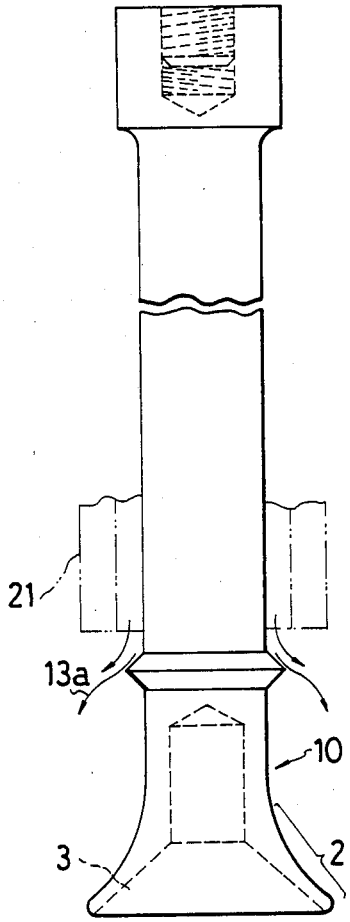
FIG. 13 is a side elevational view of a vibrator horn according to yet another embodiment of the invention.

FIG. 13 shows yet another embodiment of the vibrator horn according to the present invention in which the vibrator horn 10 is formed around the outer periphery of the small diameter section adjacent to said flared portion with air flow diverting or baffle means in the form of a collar **13*a*** to generate air flow to thereby divert and to damp the flow of the air directed towards the enlarged-diameter tip end of said flared portion whereby the oncoming combustion air flow directed to the atomizing surface of the horn from the outside is prevented from deteriorating the atomizing property. Otherwise, the combustion air flow would tend to force the liquid supplied to the vibrator horn to flow downward beyond the atomizing surface of the horn and/or to disturb the surface of liquid adhering to the atomizing surface, resulting in producing coarse droplets.

Figure 14:
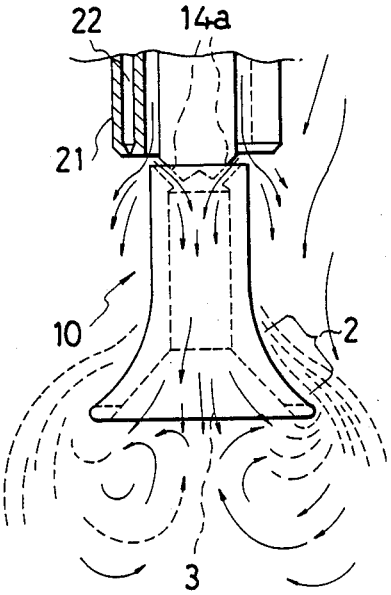
FIG. 14 is a side elevational view of a vibrator horn according to yet another embodiment of the invention.

FIG. 14 illustrates a portion of another embodiment of the ultrasonic atomizing apparatus according to this invention. In this embodiment the vibrator horn is provided with air inlet passage means **14*a* designed to introduce the oncoming air flowing through a gap between the vibrator horn and the surrounding housing into a hollow recess 3** formed in the horn.

This arrangement is useful to suppress the production of soots in the hollow recess 3 of the horn and to provide cooling effect on the horn whereby occurrence of a discrepancy in conditions of resonance between the ultrasonic vibration generating means and the vibrator horn may be prevented.

Figure 15:
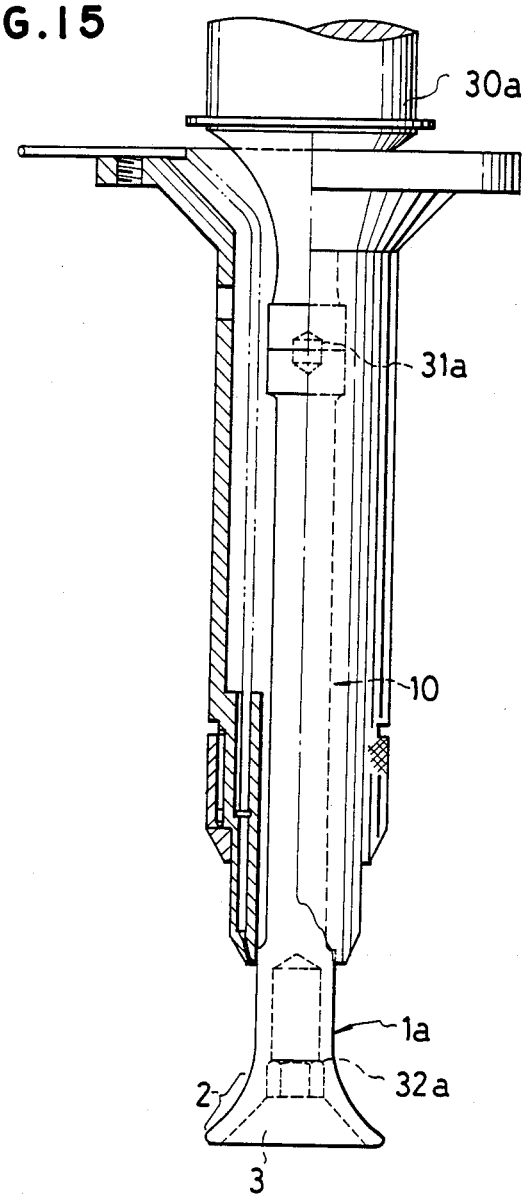
FIG. 15 is a side elevational view, partly in section of an ultrasonic atomizing apparatus having a vibrator horn according to another embodiment of the invention.

FIG. 15 illustrates still another embodiment of the ultrasonic atomizing apparatus according to the present invention in which the arrangement is such that a joint **31*a* between the ultrasonic vibration generating means 30*a* and the vibrator horn 10 detachably connected to the generating means is at a point of maximum amplitude and the wall of the recess 3 of the horn is formed with a tool (such as allen wrench) engageable socket 32*a*** or other suitable tool engageable groove means, whereby the horn may easily be assembled to the vibration generating means without affecting the atomizing property of the apparatus and it is also made easily to handle the apparatus for transportation.

Figure 16:
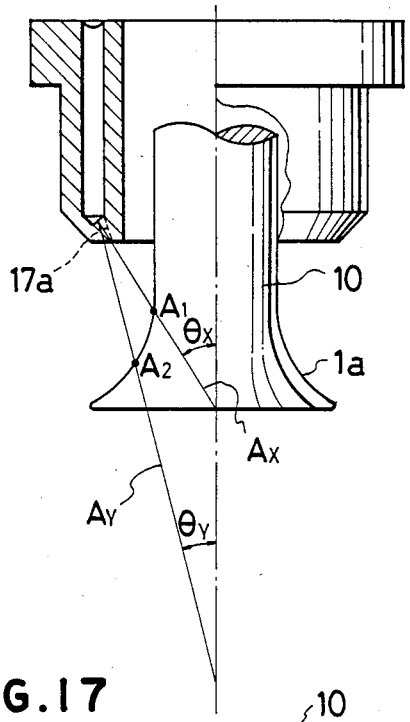
FIG. 16 is a side elevational view of a portion of an ultrasonic atomizing apparatus according to still another embodiment of the invention.
Figure 17:
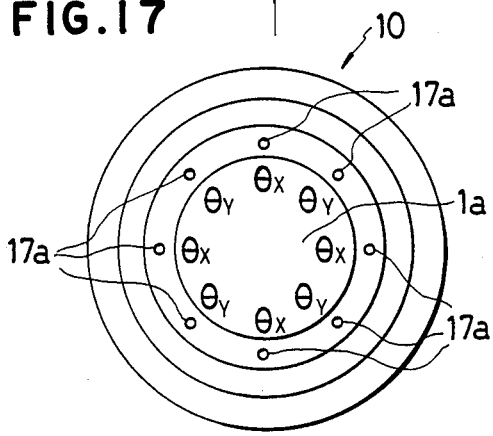
FIG. 17 is a bottom view of the liquid supply means shown in FIG. 16.
Figure 18:
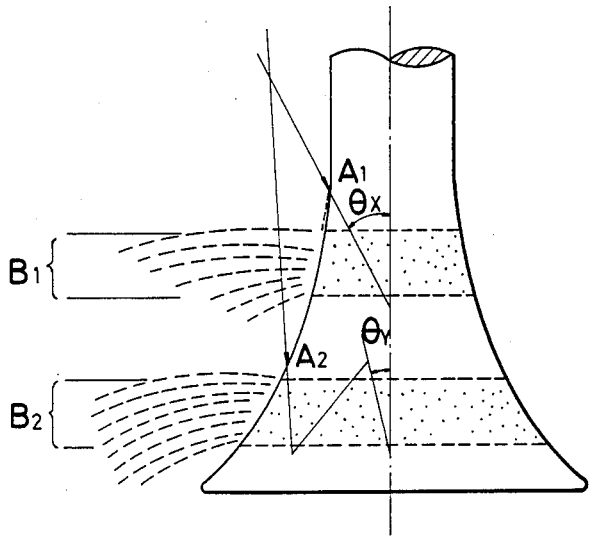
FIG. 18 is a side view of a portion of the horn shown in FIG. 16 illustrating spray patterns provided by the liquid supply means of FIG. 17.

FIGS. 16 to 18 show yet another embodiment of the ultrasonic atomizing apparatus according to this invention. In this embodiment a plurality of liquid material supply means **17*a* (FIG. 17) for feeding liquid material towards the flared section 1*a* of the vibrator horn 10 are provided in a circular array around the small-diameter section of the horn. In the illustrated embodiment there are two groups of liquid supply means having their axial feed lines $A_x$ and $A_y$ intersecting at different angles $\theta_x$ and $\theta_y$, respectively with the longitudinal axis of the horn, whereby one group of liquid supply means directs the liquid against either the small-diameter section or the boundary between the small-diameter section and the flared portion at a first feed point $A_1$ while the other group directs the liquid against the flared portion at a second feed point $A_2$. When the flared section 1*a*** of the horn has a maximum diameter of 32 mm, for example at the tip end, the angles $\theta_x$ and $\theta_y$ may be 40° and 20°, respectively.

By this arrangement, a plurality of stages $B_1$ and $B_2$ of atomizing zones (FIG. 18) are defined on the outer periphery of the flared section of the horn whereby an increased atomizing surface area may be provided over the flared section to thereby permit the horn to atomize liquid to finer droplets and increase the atomizing rate and hence further improve the atomizing property. While in the embodiments as stated above the flared portion of the ultrasonic vibrator horn according to the present invention has been described, as illustrated, as having a trumpet-shaped outer periphery surface, the flared portion may naturally have a conical outer periphery surface.

Figure 19:
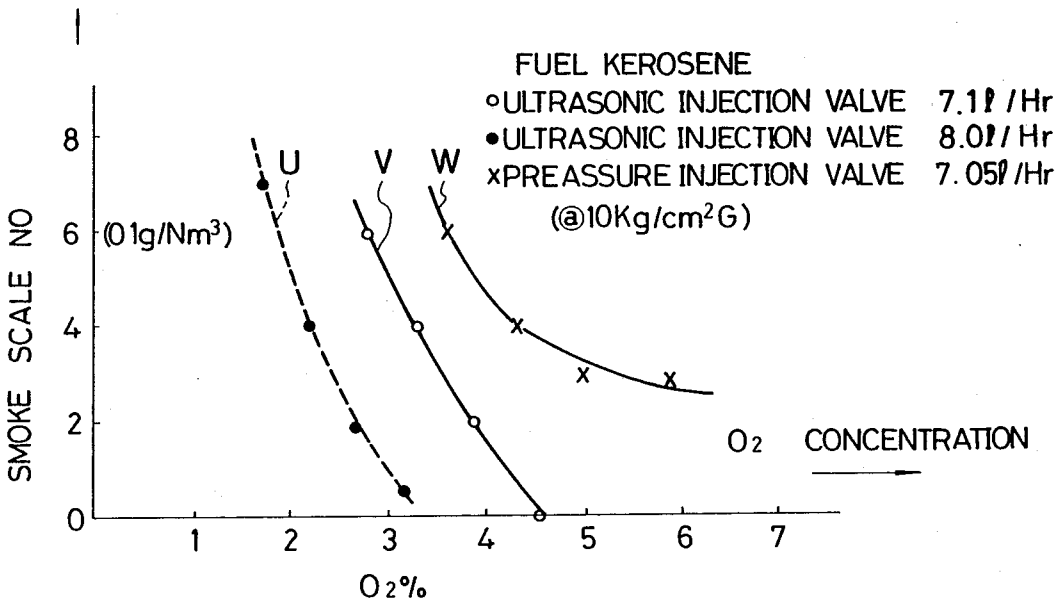
FIG. 19 is a graph showing the comparison result of the combustion property of the ultrasonic atomizing apparatus according to the invention and the combustion property of a conventional pressure injection valve.

FIG. 19 shows a combustion characteristics of the ultrasonic atomizing apparatus according to the present invention as applied to a boiler by way of example.

More particularly, FIG. 19 in which the ordinate axis is used to represent the smoke scale No. (determinations measured by means of a smoke tester manufactured by Bacharach Company) and the abscissa axis is used to represent the oxygen concentration indicates the comparison results of the combustion characteristics of ultrasonic atomizing in the ultrasonic atomizing apparatus according to the present invention and the combustion characteristics of pressure atomizing in the conventional pressure injection valve.

The smoke scale No. is obtained by sampling a given amount of the exhaust gas to measure the density of soot and varies corresponding to the change of the soot in amount, which measurement is based on a standard method for measuring soot density prescribed in ASTM Da 15665.

The combustion characteristics as shown in FIG. 19 represent the combustion characteristics (lines shown by U and V in FIG. 19) of the ultrasonic atomizing apparatus according to the present invention which was applied to a boiler and had an ultrasonic vibrator horn with the slope angle at the tip end of the horn of 25°, the diameter of the small-diameter section of 11 mm and the diameter of the enlarged-diameter section of 24 mm, and the combustion characteristics (line shown by W in FIG. 19) of the conventional pressure injection valve.

FIG. 19 clearly indicates that the ultrasonic atomizing by the horn according to the present invention is superior to that of the conventional horn in combustion characteristics. The horn according to the present invention may preferably be applied to various combustion apparatus such as petroleum heaters, boilers and the like.

Advantages of the Invention

From the foregoing it is to be appreciated that the ultrasonic atomizing apparatus of the present invention is capable of atomizing liquid material more effectively in a short time and in larger quantities, as compared to the prior art apparatus, and yet the atomized droplets are of very small and uniform part size. Furthermore, it requires a reduced electric power consumption to atomize liquid material, and is capable of feeding liquid material effectively from the liquid material supply means to the atomizing zone as well as easily controlling, for example, the flow rate of liquid material fed.

This apparatus is also advantageous from a viewpoint of the strength of material in that the stresses generated in the flared portion of the horn are more uniform.

In addition, according to the ultrasonic atomizing apparatus of the present invention, finer and more uniform; atomized droplets may be provided by varying the compatibility of the liquid material with the surface of the atomizing zone. The upper limit of the atomizing rate may be raised by providing a flange at the tip end of the flared portion. Disturbance of the liquid material supplied to the flared portion may be prevented by providing air flow diverting means. Production of soots may be suppressed and cooling effects on the vibrator horn may be enhanced by providing air inlet passage means leading to the hollow recess. Further, it may be made easy to assemble and handle the ultrasonic vibration generating means and the vibrator horn by detachably connecting the two.

The present invention may suitably be used with various ultrasonic atomizing apparatus which atomize the liquid materials by the use of ultrasonic vibration. More particularly, the present invention, as described above, may be effectively used with (a) automobile fuel injection devices such as electronically controlled gasoline injection valves and electronically controlled diesel fuel injection valves, (b) gas turbine fuel nozzles, (c) burners for use on industrial, commercial and domestic boilers, heating furnaces and heating devices, (d) industrial liquid atomizers such as drying atomizers for drying liquid materials such as foods, medicines, agricultural chemicals, fertilizers and the like, spray heads for controlling temperature and humidity, atomizers for calcining powders (pelletizing ceramic), spray coating devices and reaction promoting devices, and (e) liquid atomizers for uses other than industrial ones, such as spreaders for agricultural chemicals and antiseptic solution.

Although the present invention has been described in its preferred embodiments with a certain degree of particularity, it should be understood that the present disclosure of the preferred embodiments can be changed without departing from the spirit and the scope of the present invention, and accordingly the present invention is not limited to the above-mentioned embodiments at all.

We claim:

1. An ultrasonic atomizing apparatus including an ultrasonic vibration generating means and an ultrasonic vibrator horn having a cylindrical section connected at one end of said ultrasonic vibration generating means and having a flared portion connected to the other end of the cylindrical section, said flared portion being flared and enlarged in diameter towards the tip end of the horn, said apparatus being adapted to atomized liquid material on said flared portion as the liquid material is supplied from liquid material supply means to the flared portion, characterized in that a hollow recess is formed in said flared portion, said hollow recess opening towards the tip of the horn, the geometry of said hollow recess being such that the cross-sectional area of the flared portion of the horn in any plane perpendicular to the longitudinal axis of the horn is substantially the same as the cross-sectional area of the flared portion in all other planes perpendicular to the longitudinal axis of the horn, the horn also having a single nodal point positioned above a boundary between said cylindrical section and the flared portion when said horn is ultrasonically excited.

2. An ultrasonic atomizing apparatus according to claim 1 wherein the wall thickness of said hollow recessed section at the tip end thereof is not greater than 20% of the radius of the flared portion at the tip end thereof.

3. An ultrasonic atomizing apparatus according to claim 1 in which the arrangement is such that the tip end of said flared portion provides a maximum amplitude.

4. An ultrasonic atomizing apparatus according to claim 1 wherein said flared portion has a conical outer peripheral surface.

5. An ultrasonic atomizing apparatus according to 1 wherein said flared portion has a conical and curved outer peripheral surface or trumpet-shaped surface.

6. An ultrasonic atomizing apparatus according to any claim 1 wherein the apical angle of the outer peripheral surface of the flared portion is in the range from 30° to 60°, and the apical angle of the wall of said hollow recess with respect to the longitudinal axis of the horn is 0° to 30° greater than that of the outer peripheral surface of said flared portion.

7. An ultrasonic atomizing apparatus according to any claim 1 wherein an atomizing zone for atomizing the liquid material is defined within a region extending from said cylindrical section to the enlarged-diameter tip end of said flared section, and an area extending over a portion of said atomizing zone and said cylindrical section is provided with a roughened surface.

8. An ultrasonic atomizing apparatus according to claim 1 wherein said flared section of the horn is formed at its enlarged-diameter tip end with a flange.

9. An ultrasonic atomizing apparatus according to claim 1 wherein said vibrator horn is formed around the outer periphery of said small-diameter section adjacent to said flared portion with baffle means to thereby divert and damp the oncoming flow of air flowing towards the enlarged-end of said flared portion.

10. An ultrasonic atomizing apparatus according to any claim 1 wherein said vibrator horn is provided with air inlet passage means adapted to introduce the oncoming air flowing through a gap defined between the vibrator horn and a housing surrounding the vibrator horn into said hollow recess.

11. An ultrasonic atomizing apparatus according to any claim 1 wherein said ultrasonic vibration generating means and said vibrator horn are detachably connected to each other.

12. An ultrasonic atomizing apparatus according to claim 11 wherein a joint between the ultrasonic vibration generating means and the vibrator horn detachably connected to said generating means is arranged so as to lie at a loop point of maximum applitude.

13. An ultrasonic atomizing apparatus according to claim 11 wherein said hollow recess is provided with groove means such as an allen wrench engageable socket for an assembling tool.

14. An ultrasonic atomizing apparatus including an ultrasonic vibration generating means and an ultrasonic vibrator horn having a cylindrical section connected at one end to said ultrasonic vibration generating means and having a flared portion connected to the other end of the cylindrical section, said flared portion being flared and enlarged in diameter towards the tip end of the horn, said apparatus being adapted to atomize liquid material on said flared portion as the liquid material is supplied from liquid material supply means to the flared portion, characterized in that a hollow recess is formed in said flared portion, said hollow recess opening towards the tip of the horn, the geometry of said hollow recess being such that the cross-sectional area of the flared portion of the horn in any plane perpendicular to the longitudinal axis of the horn is substantially the same as the cross-sectional area of the flared portion in all other planes perpendicular to the longitudinal axis of the horn, said liquid material supply means having injection nozzle means for supplying the liquid material to said flared portion of the horn oriented at a predetermined angle so as to direct the liquid material against said horn at a feed point at or above a boundary between said cylindrical section and the flared portion.

15. An ultrasonic atomizing apparatus according to claim 14 wherein said feed point at or above said boundary is positioned such that the ratio V/U is in a range from 0 to 1, where U is the diameter of said small-diameter section and V is the distance from said boundary to the feed point above said boundary.

16. An ultrasonic atomizing apparatus according to claim 14 wherein said predetermined angle is in a range from 15° to 75°.

17. An ultrasonic atomizing apparatus according to claim 14, wherein said liquid material supply means comprises at least one conduit means at least one different predetermined angle for directing the liquid material against said flared portion.

18. An ultrasonic atomizing apparatus according to any one of claim 14 wherein the wall thickness of said hollow recessed section at the tip end thereof is not greater then 20% of the radius of the flared portion at the tip end thereof.

19. An ultrasonic atomizing apparatus according to any one of claim 14 in which the arrangement is such that the tip end of said flared portion provides a maximum amplitude.

20. An ultrasonic atomizing apparatus according to any claim 14 wherein said flared portion has a conical outer peripheral surface.

21. An ultrasonic atomizing apparatus according to any claim 14 wherein said flared portion has a conical and curved outer peripheral surface or trumpet-shaped surface.

22. An ultrasonic atomizing apparatus according to any one claim 14 wherein the apical angle of the outer peripheral surface of the flared portion is in the range from 30° to 60° and the apical angle of the wall of said hollow recess with respect to the longitudinal axis of the horn is 0° to 30° greater than that of the outer peripheral surface of said flared portion.

23. An ultrasonic atomizing apparatus according to any one claim 14 wherein an atomizing zone for atomizing the liquid material is defined within a region extending from said cylindrical section to the enlarged-diameter tip end of said flared section, and an area extending over a portion of said atomizing zone and said cylindrical section is provided with a roughened surface.

24. An ultrasonic atomizing apparatus according to any claim 14 wherein said flared section of the horn is formed at its enlarged-diameter tip end with a flange.

25. An ultrasonic atomizing apparatus according to any one claim 14 wherein said vibrator horn is formed around the outer periphery of said small-diameter section adjacent to said flared portion with baffle means to thereby divert and damp the oncoming flow of air flowing towards the enlarged-end of said flared portion.

26. An ultrasonic atomizing apparatus according to any one claim 14 wherein said vibrator horn is provided with air inlet passage means adapted to introduce the oncoming air flowing through a gap defined between the vibrator horn and a housing surrounding the vibrator horn into said hollow recess.

27. An ultrasonic atomizing apparatus according to any one of claim 14 wherein said ultrasonic vibration generating means and said vibrator horn are detachably connected to each other.

28. An ultrasonic atomizing apparatus according to claim 27 wherein a joint between the ultrasonic vibration generating means and the vibrator horn detachably connected to said generating means is arranged so as to lie at a point of maximum amplitude.

29. An ultrasonic atomizing apparatus according to claim 27 wherein said hollow recess is provided with groove means such as an allen wrench engageable socket for an assembling tool.

* * * * *